US010759573B1

(12) United States Patent
Kim et al.

(10) Patent No.: US 10,759,573 B1
(45) Date of Patent: Sep. 1, 2020

(54) VARIALBE POUR FLOW DEVICE

(71) Applicant: Helen of Troy Limited, St. Michael (BB)

(72) Inventors: Sunny Kim, Astoria, NY (US); Martin Mutch, New York, NY (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 16/281,552

(22) Filed: Feb. 21, 2019

(51) Int. Cl.
*B65D 47/06* (2006.01)
*B65D 47/04* (2006.01)

(52) U.S. Cl.
CPC ..... *B65D 47/06* (2013.01); *B65D 47/043* (2013.01)

(58) Field of Classification Search
CPC ..... B65D 47/043; B65D 47/06
USPC ..... 222/547
See application file for complete search history.

(56) References Cited

U.S. PATENT DOCUMENTS 1,456,408 A 5/1923 Scherer
2,536,160 A 1/1951 Duggan
2,780,391 A * 2/1957 Jasuta ..... B65D 47/06 222/109
3,091,373 A * 5/1963 Kirschenbaum ..... G01F 11/262 222/420
3,311,275 A * 3/1967 Gibson ..... B65D 47/043 222/567
3,330,450 A * 7/1967 Clare ..... A47J 36/14 222/479
4,241,855 A 12/1980 Yoshioka
4,597,513 A * 7/1986 Schiemann ..... B65D 47/06 222/478
4,637,530 A * 1/1987 Jiang ..... B65D 25/42 222/564
4,674,654 A 6/1987 Fujii et al.
4,856,685 A 8/1989 Gaffney
5,123,575 A 6/1992 Li
6,758,375 B2 7/2004 Ho
7,757,886 B2 7/2010 Ho
8,701,929 B1 * 4/2014 Long ..... B65D 25/22 215/276
8,960,506 B2 * 2/2015 Beilke ..... B65D 47/0828 222/481.5

(Continued)

FOREIGN PATENT DOCUMENTS

GB 352708 7/1931
JP 2009040425 2/2009

(Continued)

*Primary Examiner* — J C Jacyna
(74) *Attorney, Agent, or Firm* — Rankin Hill & Clark LLP

(57) ABSTRACT

A cap for a variable pour flow device is configured to close an opening of a container holding a liquid when assembled with the container. The cap includes a spout in communication with an interior of the container when the cap is assembled with the container. The cap is further configured to provide a first fluid flow in which fluid flows through a first passage and the spout when the container with the cap assembled thereto is tilted from an upright position toward the spout to an intermediate degree. The cap is also configured to provide a second, greater fluid flow in which fluid flows through the first passage, a larger second passage, which is spaced from the first passage, and the spout when the container with the cap assembled thereto is tilted further toward the spout from the intermediate degree.

17 Claims, 6 Drawing Sheets

(56) References Cited

U.S. PATENT DOCUMENTS

| | | | | |
|---|---|---|---|---|
| 9,181,003 | B2 * | 11/2015 | Frisch | B65D 23/04 |
| 9,669,970 | B2 | 6/2017 | Martinez Carregui et al. | |
| 2005/0184026 | A1 * | 8/2005 | Haley | B65D 47/06 215/306 |
| 2007/0295767 | A1 | 12/2007 | Angelo et al. | |
| 2008/0156817 | A1 * | 7/2008 | Roseblade | A47G 19/2211 220/713 |
| 2014/0332568 | A1 | 11/2014 | Stratton | |
| 2016/0297576 | A1 * | 10/2016 | Hill | B65D 47/122 |
| 2018/0312303 | A1 * | 11/2018 | Meyer | B65D 41/0442 |

FOREIGN PATENT DOCUMENTS

| | | |
|---|---|---|
| WO | 01/38190 | 5/2001 |
| WO | 2013/186522 | 12/2013 |

* cited by examiner

VARIALBE POUR FLOW DEVICE

BACKGROUND

Devices for pouring contents contained therein typically include a container for containing contents to be poured, and a cap for closing the container and facilitating pouring contents of the container in a controlled manner. One known problem with pouring devices is the lack of user control over the flow rate of the pouring device. While some pouring device caps are configured to limit a flow rate through the cap to a single, relatively consistent and controlled flow when the pour device is tilted within a range of angles, other spouts have a more open configuration that feature a flow rate varying with the degree of tilt. Neither type of pour flow device features both a variation of the pour flow rate while also featuring a relatively consistent and controlled flow when the pour device is tilted.

Additionally, pouring contents from a container replaces the contents from the container with atmospheric air surrounding the container. Insufficient air or interruption of the passage of air into the container affects the manner in which the liquid flows from the container. When the pouring device is tilted to pouring position, the liquid flows out of the cap from the container such that the air in the container is above the liquid, and the entering air and discharging liquid must pass in opposite directions. This causes an uncontrolled flow that is uneven and inconsistent when pouring contents from the pouring device.

SUMMARY

According to one aspect, a cap for a variable pour flow device is disclosed. The cap is configured to close an opening of a container holding a liquid when assembled with the container. The cap includes a spout in communication with an interior of the container when the cap is assembled with the container. The cap is further configured to provide a first fluid flow in which fluid flows through a first passage and the spout when the container with the cap assembled thereto is tilted from an upright position toward the spout to an intermediate degree. The cap is also configured to provide a second, greater fluid flow in which fluid flows through the first passage, a larger second passage, which is spaced from the first passage, and the spout when the container with the cap assembled thereto is tilted further toward the spout from the intermediate degree.

According to another aspect, a variable pour flow device is disclosed. The variable pour flow device includes a container and a cap assembly. The container is formed by a side wall having an inner surface defining an interior and an outer surface defining an exterior. The container also has an end defining an opening. The cap assembly includes a cover configured to substantially close the opening of the container when the cap is assembled with the container, such that the cover has a cover inner surface facing the interior of the container. The cap includes a cap wall, a spout, and a channel. The cap wall extends from the cap and has an inner surface that is configured for engaging the container around the opening of the container, such that the cap wall has a cap wall inner surface. The spout is configured for communicating liquid between the interior of the container and the exterior of the container. A channel along the cover of the cap includes at least two passages configured to communicate an inside of the channel with the interior of the container and the exterior of the container. Tilting the container from an upright position towards the spout to an intermediate degree with the cap assembled to the container facilitates fluid flow into the channel through a first passage of the at least two passages. Further tilting the container from the intermediate degree towards the spout facilitates fluid flow into the channel through a second passage of the at least two passages.

DETAILED DESCRIPTION

Figure 1:
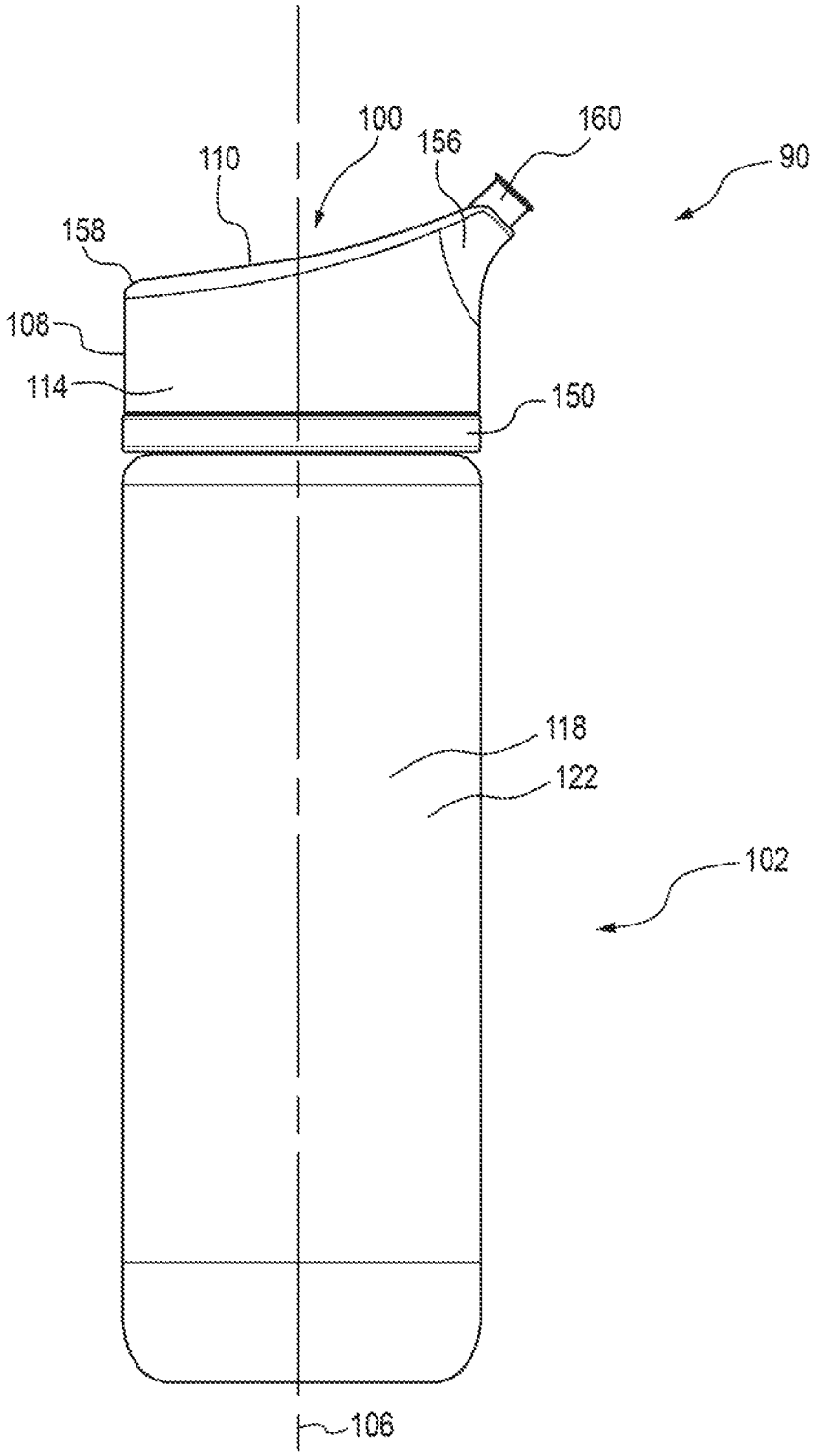
FIG. 1 is a side view of a variable pour flow device according to the present disclosure.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 illustrates an assembled variable pour flow device 90 including a cap 92 and container 102. As shown in FIG. 1, the cap 92 and container 102 assembled together are oriented in an upright position. The cap 92 is configured to close an opening 104 of the container 102 holding a liquid when assembled with the container 102. The upright position of the variable pour flow device 90 is defined herein as the orientation resulting from standing the variable pour flow device 90 on a horizontal surface such that a longitudinal axis 106 of the variable pour flow device 90 is normal to the horizontal surface.

The cap 92 includes an upper cap member 100 having a cap side wall 108 extending from a cover 110. The cap side wall 108 is generally cylindrical, and concentric about the longitudinal axis 106, which can also be considered as a central axis of the cap 92. The cover is generally circular when viewed normal to the longitudinal axis 106. The cap side wall 108 has an inner surface 112 defining an interior of the cap 92, and an outer surface 114 defining an exterior of the cap 92. A ridge 116 is integrally formed adjacent the periphery of the cover 110, protruding toward the interior of the cap 92.

Figure 2:
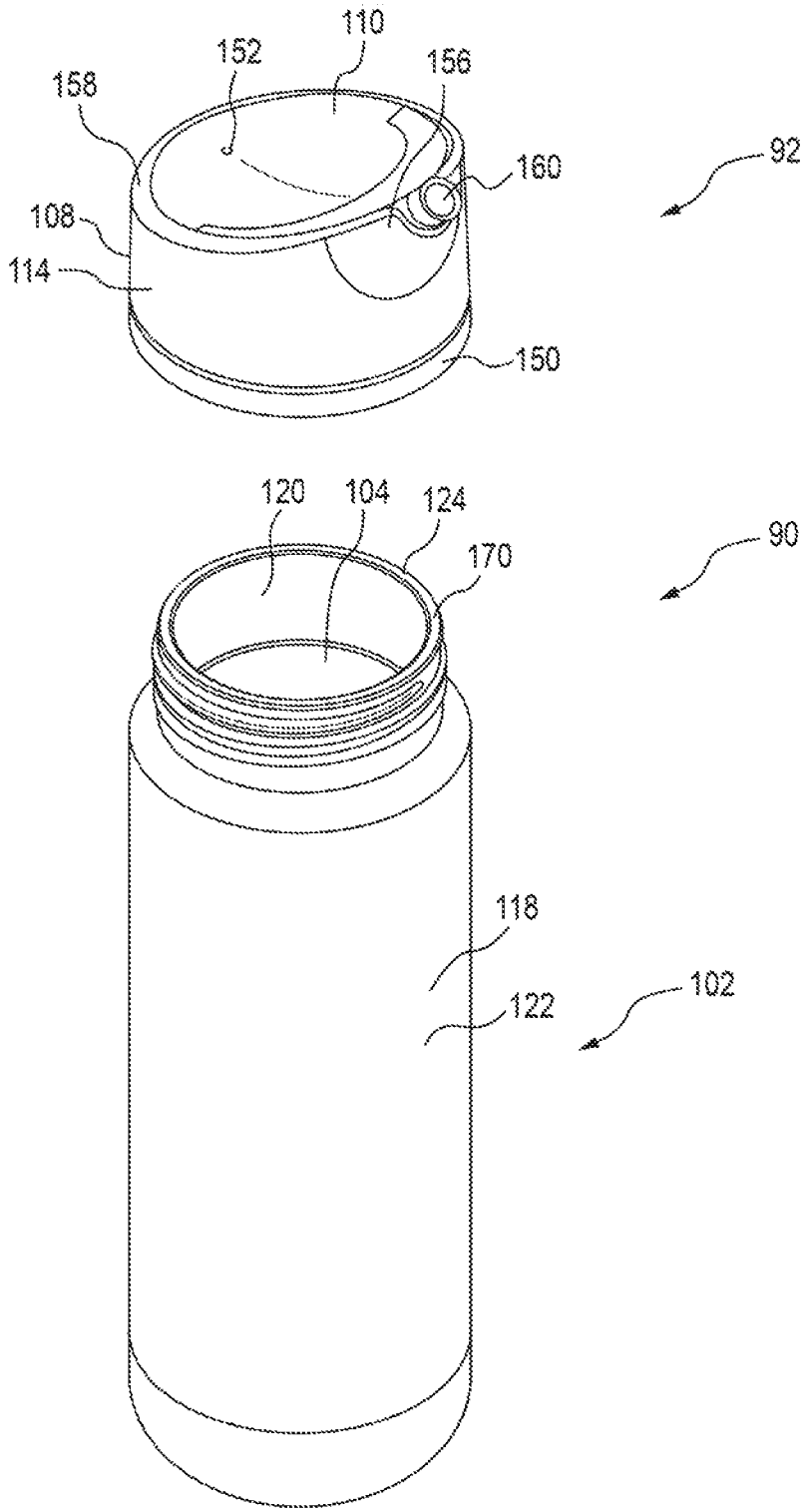
FIG. 2 is a perspective view of the variable pour flow device of FIG. 1 partially unassembled.

With reference to FIG. 2, the container 102 is formed by a wall 118 having an inner surface 120 defining an interior of the container and an outer surface 122 defining an exterior of the container. The container 102 has an end 124 defining the opening 104 of the container. The container 102 can be sized to be hand-held, e.g., picked up by an adult with one hand, and can be useful in storing liquids, such as cooking oil, salad dressing, cream and other consumable liquids.

Figure 3:
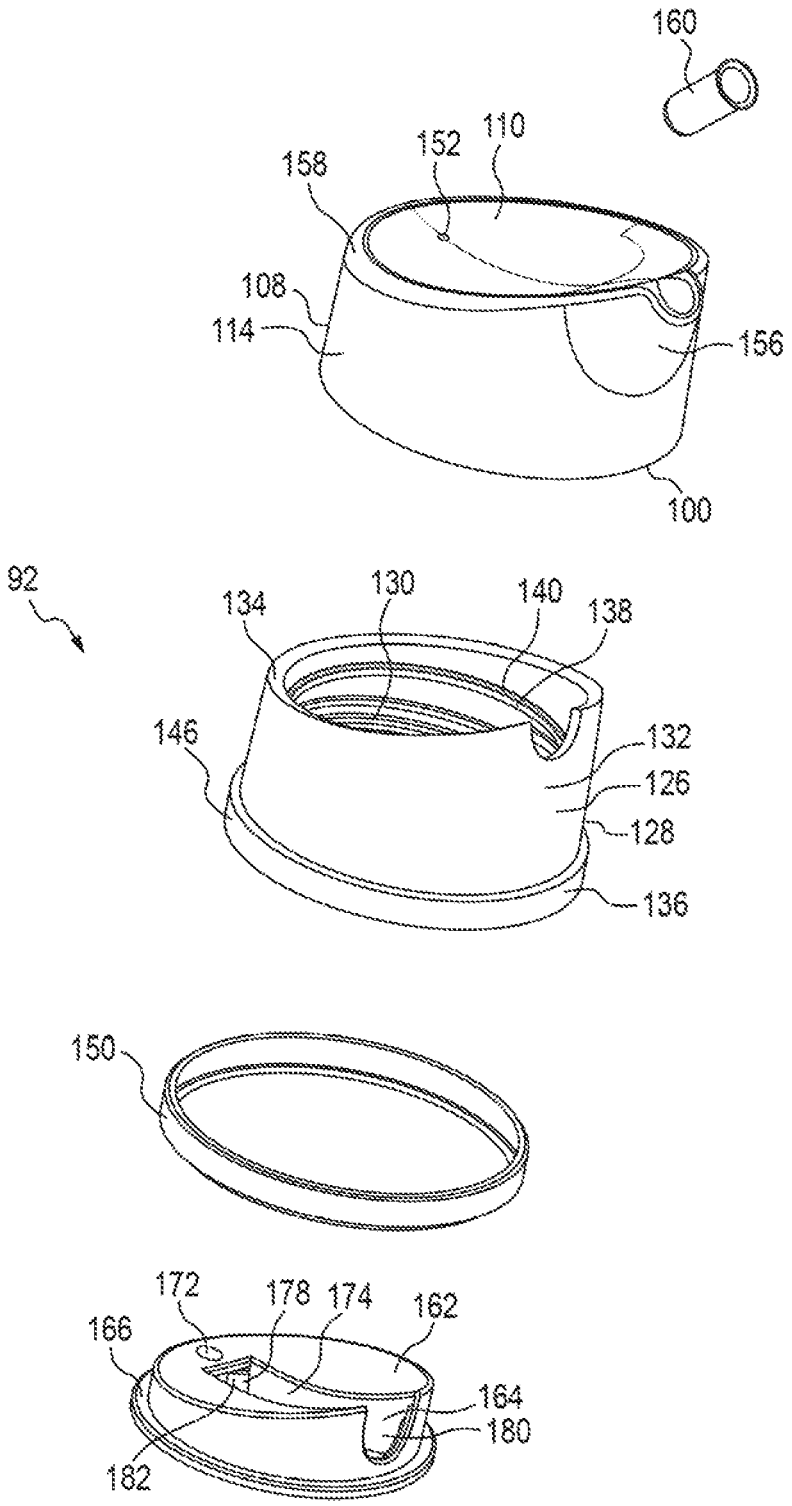
FIG. 3 is an exploded perspective view of a cap for the variable pour flow device shown in FIG. 1.
Figure 4:
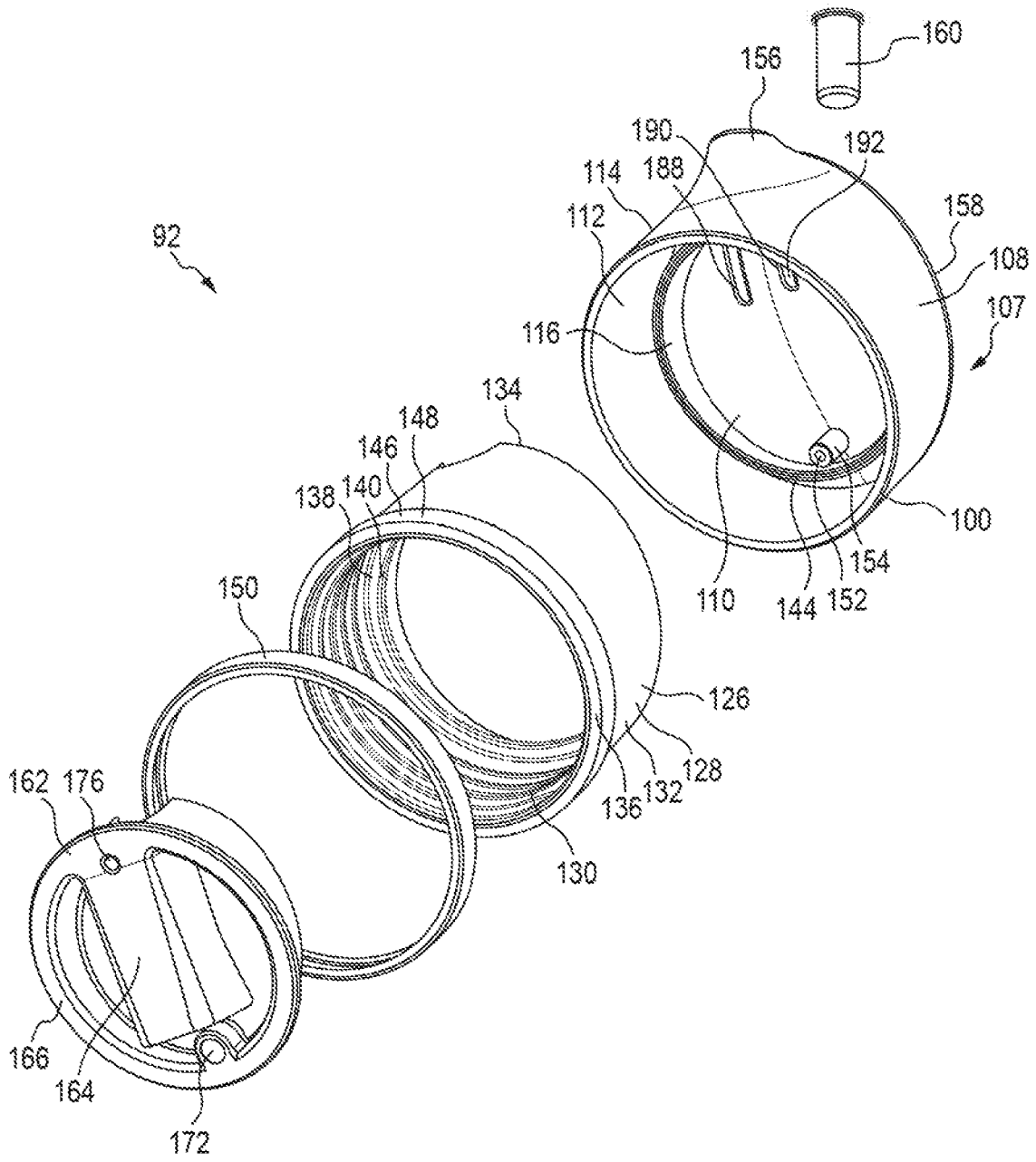
FIG. 4 is an exploded perspective view from below the cap for the variable pour flow device of FIG. 1.

With reference to FIGS. 3 and 4, the cap 92 further includes a first insert 126 received in the upper cap member 100 between the cap side wall 108 and the ridge 116. The first insert 126 includes an insert side wall 128 having an inner surface 130 facing the interior of the cap 92, and an outer surface 132 facing the exterior of the cap 92 when the cap 92 is assembled. Further, the insert side wall 128 has a first end 134 configured for engaging the upper cap member 100 between the ridge 116 and cap side wall 108, and a second end 136 opposite from the first end 134 relative to the insert side wall 128. The inner surface 130 of the insert side wall 128 is threaded, being configured to engage a threads of the container 102.

A first flange 138 protrudes inwardly toward the longitudinal axis 106 from the inner surface 130 of the insert side wall 128, and is configured to contact the ridge 116 when the cap 92 is assembled. To this end, the first flange 138 features teeth 140 on an upper surface 142 of the first flange 138, and the teeth 140 are configured to contact the ridge 116 upon assembly of the cap 92. Also, the ridge 116 features a groove pattern 144 facing the teeth 140, and the groove pattern 144 is configured for engaging the teeth 140 upon assembly of the cap 92. The first insert 126 is ultrasonically welded to the upper cap member 100 to connect the two components where the groove pattern 144 contacts the teeth 140. Alternatively, the upper cap member 100 could be overmolded onto the first insert 126 to connect the two components.

A second flange 146 integrally protrudes outwardly from the second end 136 of the first insert 126 toward the exterior of the cap 92 when the cap 92 is assembled, such that an outermost surface 148 of the second flange 146 aligns with the outer surface 114 of the cap side wall 108. A steel ring 150 is disposed on the second flange 146 of the first insert 126, around the outermost surface 148 of the ridge 116.

The upper cap member 100, and more particularly the cover 110 includes an air vent 152 configured for communicating air pressure between the interior of the container 102 and the exterior of the container 102 when the cap 92 is assembled with the container 102. A boss 154 extends from the cover 110 toward the interior of the cap 92, and the air vent 152 is a through hole disposed through the boss 154. The air vent 152 is located on the cover 110, on a side of the cover 110 opposite from a spout 156.

The spout 156 brings the exterior of the container 102 in communication with the interior of the container 102 for fluid passage when the variable pour flow device 90 is assembled. The spout 156 is located on a side of the cap 92 opposite from the air vent 152, and extends from the upper cap member 100 at an edge 158 formed between the cover 110 and the cap side wall 108. The cover 110 is curved to bend toward the interior of the cap 92, and the spout 156 extends from the upper cap member 100 in a direction substantially matching the incline of the cover 110 relative to the wall of the container 102, such that the spout 156 and cover 110 form a substantially continuous surface, facilitating an unimpeded fluid flow to the spout 156. The spout 156 includes a tube 160 inserted in the cap 92, extending the spout 156. The tube 160 can be made from steel and include a rolled distal edge to inhibit dripping.

The cap 92 further includes a second insert 162 having a baffle 164 and a gasket 166. The baffle 164 and the gasket 166 are integrally formed from the second insert 162 in the illustrated embodiment. The gasket 166 is generally L-shaped, and is seated about the periphery of the upper cap member 100 below the first flange 138 of the insert side wall 128 and between the ridge 116 and the boss 154. The gasket 166 is positioned between a lower surface 168 of the first flange 138 and an upper edge 170 on the end 124 of the container 102. The second insert 162 includes a hole 172 that receives the boss 154. The second insert 162 is made of silicone, or another flexible material. In an alternative embodiment, the second insert 162 is instead integrally formed with the cover 110.

When the cap 92 is assembled, the baffle 164 extends from the cover 110 to define a channel 174 disposed within the interior of the cap 92, along the cover 110 of the cap 92. The longitudinal direction of the channel 174 formed by the baffle 164 is aligned from the air vent 152 to the spout 156. The length of the baffle 164 extends from the air vent 152 to the spout 156. In the illustrated embodiment, the baffle 164 has a substantially square U-shaped cross section taken normal to longitudinal direction. The baffle 164 further defines a first passage 176 and a second passage 178, each of which are configured to communicate the interior of the container 102 and the channel 174. The baffle 164 further defines a first open end 180 (FIG. 3) of the channel 174 directed toward the spout 156.

Figure 5:
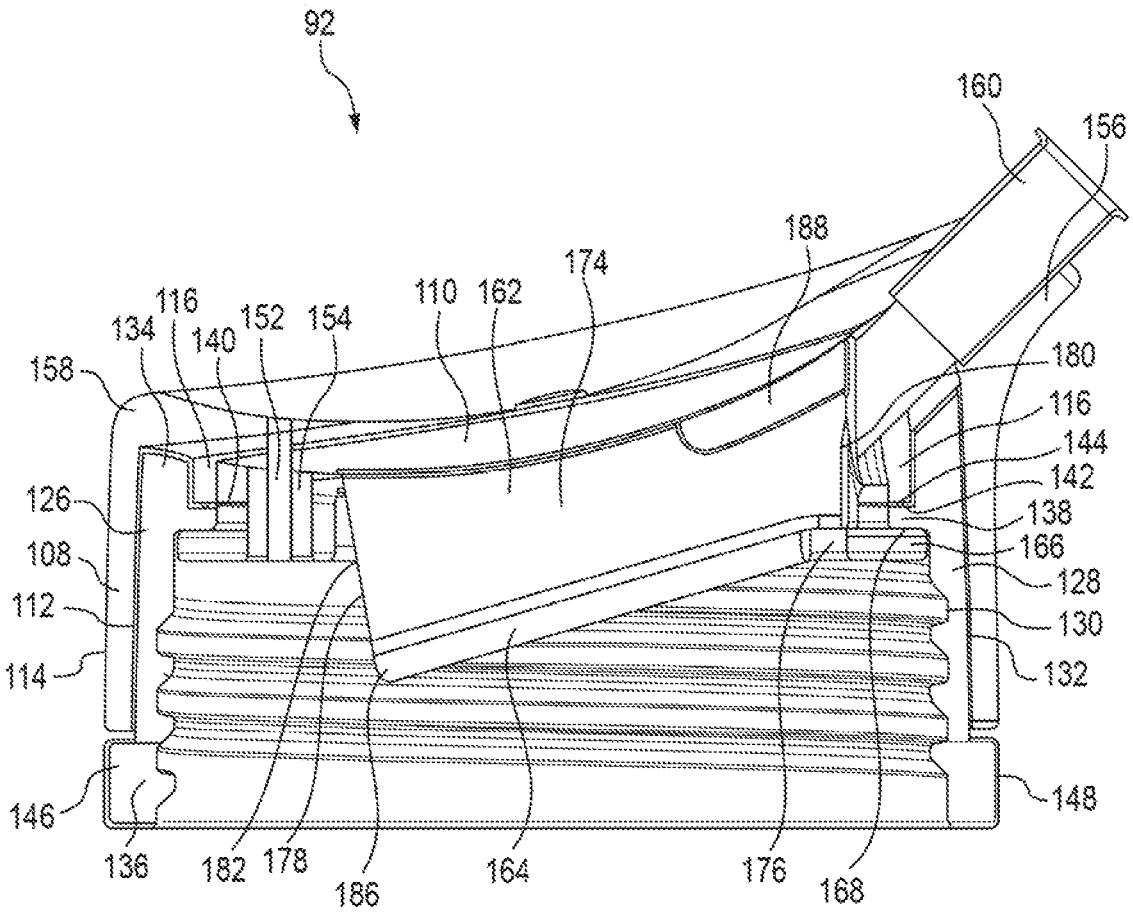
FIG. 5 is a cross-sectional view of the cap for the variable pour flow device of FIG. 1.

The first passage 176 extends through the baffle 164 into the channel 174. The second passage 178 is defined by a second open end 182 of the channel 174, and spaced from the first passage 176. Specifically, the second passage 178 is located on a side of the channel 174 opposite from the first passage 176, farther away from the spout 156. Considering a longitudinal plane 184 (not shown) bisecting the cap 92 along which the longitudinal axis resides, the first passage 176 and the second passage 178 are located on opposite sides of the plane, with the first passage 176 located closer to the spout 156 than the second passage 178. The air vent 152 terminates in the interior of the cap 92 at a vertically higher location than a lower most end 186 of the baffle 164 adjacent the second passage 178 when the cap 92 is in the upright position, as shown in FIG. 5.

A first rib 188 and a second rib 190 extend downwardly from the cover 110 toward the interior of the cap 92. Each of the ribs 188, 190 are integrally formed with the upper cap member 100 and feature a respective outer side surface (only outer side surface 192 being visible in FIG. 4) configured to engage the baffle 164. The ribs 188, 190 provide a locating feature for the baffle 164 when assembling the baffle 164 with the upper cap member 100. The ribs 188, 190 may be aligned in a parallel orientation and further aligned according to longitudinal position and lateral position relative to the channel 174. The ribs 188, 190 may be symmetric about the channel 174, disposed on either side of the channel 174, and partially define the channel 174. Regarding lateral position relative to the channel 174, the ribs 188, 190 are closer to the spout 156 than the air vent 152.

Figure 6:
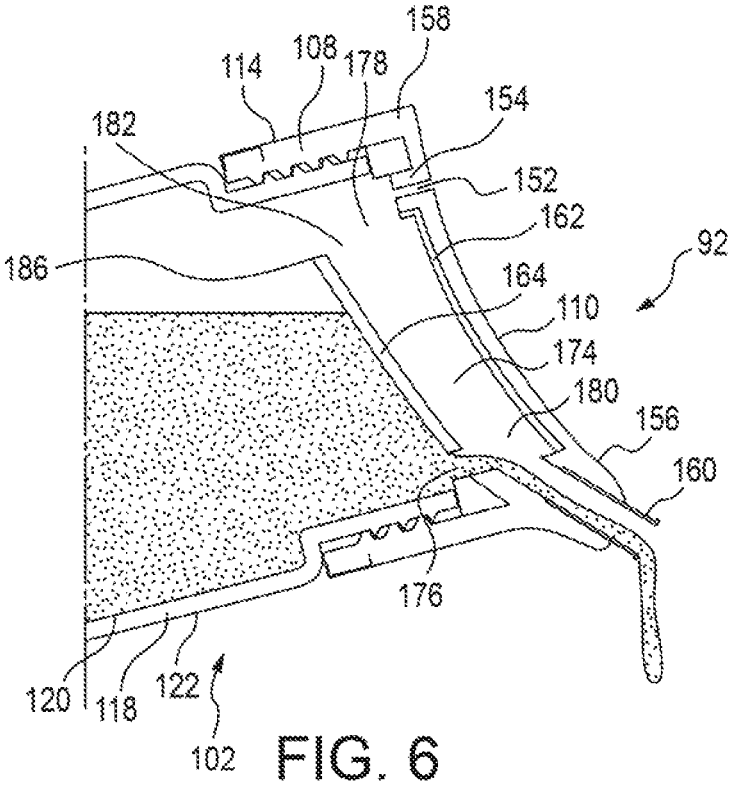
FIG. 6 is a schematic cross-sectional view showing the variable pour flow device tilted at an intermediate degree.
Figure 7:
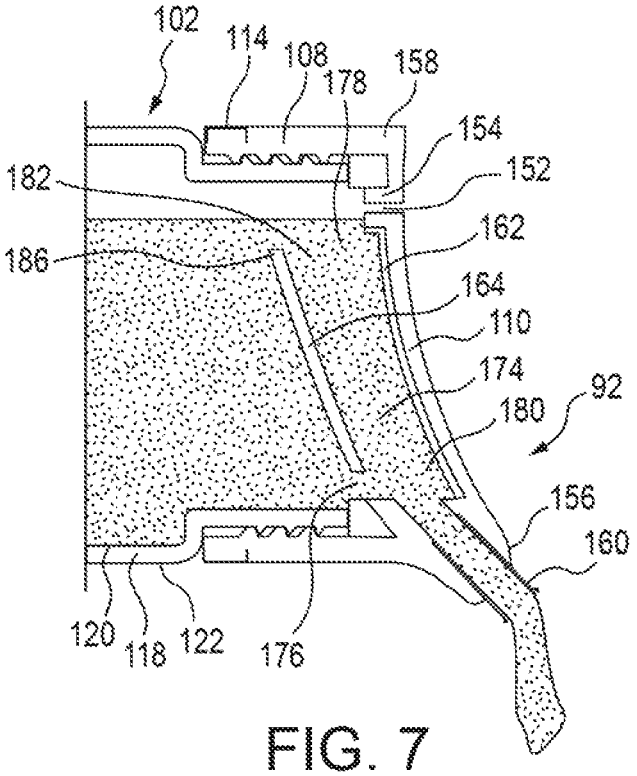
FIG. 7 is a schematic cross-sectional view showing the variable pour flow device tilted further from the intermediate degree.

Tilting the assembled variable pour flow device 90 from the upright position towards the spout 156 to an intermediate degree with the cap 92 assembled to the container 102 facilitates a first fluid flow through the first passage 176, which is shown in FIG. 6. Further tilting the container 102 from the intermediate degree towards the spout 156 facilitates a second fluid flow, which is greater in volume than the first fluid flow, through a second passage 178, which is shown in FIG. 7. The first passage 176 is smaller than the second passage 178, such that the fluid flow through the second passage 178 may be greater than fluid flow through the first passage 176. As seen when comparing FIG. 6 to FIG. 7, fluid does not flow through the second passage 178 when the container 102 is tilted to the intermediate degree. By having a substantially square U-shaped cross section, the baffle 164 is provided with a substantially planar lower surface so that when tilted beyond the intermediate degree, for example a degree between FIG. 6 and FIG. 7 where the fluid just begins to enter the second passage 178, a larger volume of fluid can pass into the channel 174 as compared to a more curved U-shaped cross section.

It will be appreciated that various descriptions of the above-disclosed variable pour flow device and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A cap for a variable pour flow device configured to close an opening of a container holding a liquid when assembled with the container, the cap including a spout in communication with an interior of the container when the cap is assembled with the container, the cap being configured to provide:

a first fluid flow in which fluid flows through a first passage and the spout when the container with the cap assembled thereto is tilted from an upright position toward the spout to an intermediate degree; and a second, greater, fluid flow in which fluid flows through the first passage, a larger second passage, which is spaced from the first passage, and the spout when the container with the cap assembled thereto is tilted further toward the spout from the intermediate degree;

and the cap further includes an insert having a baffle defining the first passage and the second passage, wherein a longitudinal plane bisects the cap along which a central axis of the cap resides, and the first passage and second passage are located on opposite sides of the plane, with the first passage located closer to the spout than the second passage.

2. The cap for the variable pour flow device of claim 1, wherein fluid does not flow through the second passage when the container is tilted to the intermediate degree.

3. The cap for the variable pour flow device of claim 1, wherein the first passage and the second passage are disposed adjacent opposite ends of the baffle.

4. The cap for the variable pour flow device of claim 1, wherein the cap defines a cap interior, and an air vent disposed in the cap terminates in the cap interior at a vertically higher location than a lower most end of the baffle adjacent the second passage when the cap is in the upright position.

5. The cap for the variable pour flow device of claim 1, wherein the first passage is located closer to the spout than the second passage.

6. The cap for the variable pour flow device of claim 1, wherein the baffle defines a channel in communication with the first passage and the second passage having a substantially square U-shaped cross section taken normal to a longitudinal direction of the channel.

7. The cap for variable pour flow device of claim 1, wherein the insert is made of flexible material.

8. The cap for the variable pour flow device of claim 7, wherein the cap further includes an air vent configured for communicating air pressure between the interior of the container and the exterior of the container, and a boss extending downwardly from a cover toward the interior of the container when the cap is assembled with the container in the upright position, and wherein the air vent is a through hole disposed through the boss, and the insert made from the flexible material engages the container and the boss.

9. The cap for the variable pour flow device of claim 1, wherein the cap includes threads configured for engaging the container.

10. The cap for the variable pour flow device of claim 9, wherein the cap includes a flange facing the interior of the container when the cap is assembled with the container, and the cap further includes a gasket seated on the flange, the gasket being configured to engage the container when the cap is assembled with the container.

11. The cap for the variable pour flow device of claim 10, wherein the cap includes an upper cap member having a ridge that faces the interior of the container when the cap is assembled with the container, the ridge being configured to support the flange against the gasket when the cap is assembled with the container.

12. The cap for the variable pour flow device of claim 1, wherein the cap includes an upper cap member having a ridge that faces the interior of the container when the cap is assembled with the container, the ridge being disposed adjacent a periphery of the upper cap member.

13. A cap for the variable pour flow device configured to close an opening of a container holding a liquid when assembled with the container, the cap including a spout in communication with an interior of the container when the cap is assembled with the container, the cap being configured to provide:

a first fluid flow in which fluid flows through a first passage and the spout when the container with the cap assembled thereto is tilted from an upright position toward the spout to an intermediate degree; and a second, greater, fluid flow in which fluid flows through the first passage, a larger second passage, which is spaced from the first passage, and the spout when the container with the cap assembled thereto is tilted further toward the spout from the intermediate degree;

and the cap further includes an insert having a baffle defining the first passage and the second passage, wherein the cap further includes a gasket disposed within the cap configured to engage the wall of the container when the cap is assembled with the container, wherein the baffle and the gasket are integrally formed.

14. The cap for the variable pour flow device of claim 13, wherein the baffle and the gasket are integrally formed from silicone.

15. A variable pour flow device, comprising:

a container formed by a wall having an inner surface defining an interior and an outer surface defining an exterior, the container having an end defining an opening;

a cap assembly including:

a cover configured to substantially close the opening of the container when the cap is assembled with the container, such that the cover has a cover inner surface facing the interior of the container;

a cap wall extending from the cover and configured for engaging the container around the opening of the container, such that the cap wall has a cap wall inner surface;

a spout configured for communicating liquid between the interior of the container and the exterior of the container; and a channel along the cover having at least two passages configured to communicate an inside of the channel with the interior of the container, and an open end directed toward the spout;

wherein tilting the container from an upright position towards the spout to an intermediate degree with the cap assembled to the container facilitates fluid flow into the channel through a first passage of the at least two passages, and further tilting the container from the intermediate degree towards the spout facilitates fluid flow into the channel through a second passage, of the at least two passages;

wherein the channel and the at least two passages are at least partially defined by a baffle extending from the cover;

wherein the cap further includes a gasket disposed within the cap, the gasket being integrally formed with the baffle and configured to engage the container when the cap is assembled with the container.

16. The variable pour flow device of claim 15, wherein the first passage of the channel is smaller than the second passage of the channel.

17. The variable pour flow device of claim 15, wherein the cap includes an air vent spaced from the spout, the first passage, and the second passage, the air vent being configured for communicating air pressure between the interior of the container and the exterior of the container.

* * * * *